United States Patent [19]

Mitsuya

[11] 4,281,939

[45] Aug. 4, 1981

[54] MECHANICAL PENCIL

[76] Inventor: Yoshihide Mitsuya, 1-4-106, Nagata 3-chome, Jyotoh-ku, Osaka-shi, Japan

[21] Appl. No.: 45,262

[22] Filed: Jun. 4, 1979

[51] Int. Cl.[3] ..... B43K 21/22; B43K 21/16

[52] U.S. Cl. ..... 401/54; 401/65; 401/80

[58] Field of Search ..... 401/54, 65, 67, 80

[56] References Cited

U.S. PATENT DOCUMENTS

| | | | |
|---|---|---|---|
| 562,303 | 6/1896 | Kaiser | 401/82 |
| 813,522 | 2/1906 | Ronssean | 401/80 |
| 1,153,115 | 9/1915 | Keeran | 401/80 |
| 1,508,171 | 9/1924 | D'Olier | 401/80 |
| 1,729,814 | 10/1929 | Becker | 401/54 |
| 1,969,085 | 8/1934 | Leistenschneider et al. | 401/67 |
| 2,108,442 | 2/1938 | Phillips | 401/82 |
| 2,231,410 | 2/1941 | Kern et al. | 401/54 |
| 2,306,494 | 12/1942 | Otto et al. | 401/80 |
| 2,369,224 | 2/1945 | Ferger | 401/54 |
| 2,473,149 | 6/1949 | Jneles | 401/65 |
| 3,537,799 | 11/1970 | Sakamoto | 401/67 |

FOREIGN PATENT DOCUMENTS

| | | | |
|---|---|---|---|
| 1201699 | 8/1970 | United Kingdom | 401/80 |

*Primary Examiner*—William Pieprz

*Attorney, Agent, or Firm*—Wenderoth, Lind & Ponack

[57] ABSTRACT

A mechanical pencil wherein a lead is propelled through a lead insertion tube provided at the forward end of the pencil body by the propulsion of a lead sustaining and feeding mechanism consisting of a chuck and the like, the mechanical pencil also having a lead protective device wherein a thin film made of an elastic material, such as rubber, synthetic resin or the like, is provided over the whole length of the inner surface of the lead insertion tube so that the lead is permitted to pass therethrough with ease, the elastic thin film being adapted to have a relatively greater thickness at the forward end part of the lead insertion tube so as to form a lead sustaining portion, the elasticity of the lead sustaining portion precluding the lead from slipping out due to own weight when released from the lead sustaining and feeding mechanism thereby minimizing the loss of lead.

1 Claim, 7 Drawing Figures

MECHANICAL PENCIL

The invention relates to an improvement of the lead protective device of a mechanical pencil, and more particularly to an improvement of the lead protective device constituted by a lead insertion tube and a lead sustaining portion provided at the forward end of the pencil body.

A mechanical pencil wherein a lead is adapted to be propelled by operating a lead sustaining and feeding mechanism by pressing with a finger, the mechanism comprising a chuck or the like provided on the inside of the pencil body as disclosed, for example, by the U.S. Pat. No. 3,537,799, is generally known.

Such mechanical pencil, however, needs an improvement in respect of the risk of the lead slipping out of the lead insertion tube due to its own weight or when it is broken off when released from the lead sustaining and feeding mechanism during the propulsion thereof. Thus, U.S. Pat. No. 3,537,799 discloses a lead protective device comprising a lead insertion tube and a lead sustaining portion formed at the forward end of the pencil body.

The lead protective device of this type is as shown in FIGS. 1 and 2 of the accompanying drawings.

In FIG. 1, as disclosed, for example, by the U.S. Pat. No. 2,473,149, a lead insertion tube 31 combined with a forward end tube 32 is securely fixed to the forward end of the pencil body (A), and a tubular lead protective member 34 made of an elastic material, such as rubber or the like, and having an inner hole with a relatively smaller diameter than the outside diameter of the lead is fitted into a large diameter inner end portion 33 of the lead insertion tube 31 thereby forming a lead protective device.

In FIG. 2, as disclosed, for example, by the Japanese Utility Model No. 50-24845, a lead insertion tube 41 made of metal, such as stainless steel or the like, is axially displaceably mounted on the forward end of the pencil body (A), the outer periphery of the forward end of the lead insertion tube 41 being constricted so that an annular projecting ridge 43 is formed on the inner periphery of the lead insertion hole 42 thereby forming a lead protective device.

However, the known lead protective device of the first example shown in FIG. 1 has a disadvantage in that, in case of a fine lead, for example, 0.7 or 0.3 mm in diameter, the production efficiency is reduced due to difficulty in assembling very small parts.

To be more precise, since there is no alternative but to mount the lead sustaining member 34 on the inner end portion 33 in the case of a fine lead, the distance between the forward end of the lead insertion tube and the lead sustaining member is inevitably made rather long. As a result, the lead worn short and no longer sustained by the chuck slips out of the forward end tube 32 of its own weight since it is not sustained by the forward tube end of the lead insertion tube. Thus, the device is uneconomical since relatively long pieces of lead are wasted.

According to the known lead protective device of the second example shown in FIG. 2, the length of the waste lead can be reduced since the lead protective portion or device is at the forward end of the lead insertion tube. However, because the lead insertion tube is made of metal it can not adapt to any variation of the outside diameter of the lead inserted thereinto. When the lead is too thin, it slips out of the tube 41 of its own weight, while when it is too thick, its propulsion is checked by collision with the annular projecting ridge, or breakage at the annular projecting ridge results in clogging of the lead insertion tube.

Since very high precision is required for the diameter of the lead, a protective device has not yet been put into practical use in a satisfactory form.

The invention has for an object to provide a lead protective device for a mechanical pencil particularly suitable for a fine lead, wherein a thin film made of an elastic material, such as rubber, synthetic resin or the like, is provided along the whole length of the inner surface of a lead insertion tube with a thickness such that the lead is permitted to pass therethrough with ease, the elastic thin film having a relatively greater thickness inside the forward end part of the lead insertion tube so that the inside diameter thereof is relatively smaller than the outside diameter of the lead thereby forming a lead sustaining portion. Thus, the invention can provide a mechanical pencil which has a simple construction, which can be produced at low cost, which is capable of minimizing the length of the wasted lead, and particularly suitable for a thin lead.

Referring to the accompanying drawings.

Figure 1:
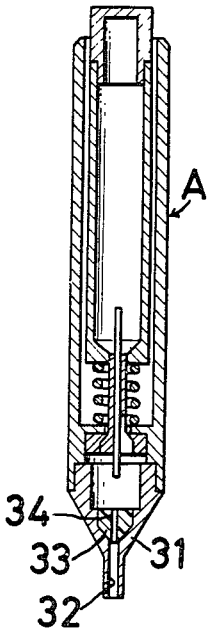
FIG. 1 PRIOR ART
FIG. 1 is a longitudinal sectional view of a known mechanical pencil provided with a conventional lead protective device.
Figure 2:
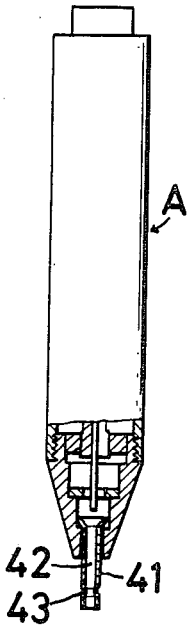
FIG. 2 PRIOR ART
FIG. 2 is a longitudinal sectional view of the principal part, broken away in part, of a known mechanical pencil provided with a different conventional lead protective device.
Figure 3:
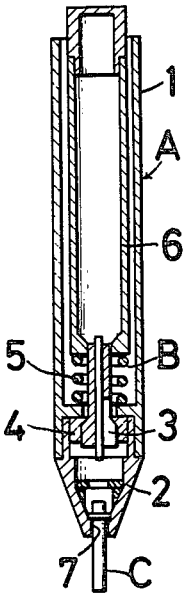
FIG. 3 is a longitudinal sectional view of a mechanical pencil provided with a lead protective device according to the invention.

The embodiment of the invention shown in FIG. 3 is a mechanical pencil of the slide type in which the lead protective device provided on the forward end part of the pencil body (A) is adapted to be displaceable.

In FIG. 3, (A) designates the pencil body comprising a stem tube 1 and a forward end tube 2 provided on the forward end of the stem tube 1 by means of fitting or a similar means.

Inside the stem tube 1 there is provided a lead sustaining and feeding mechanism (B) comprising a chuck 3, a chuck ring 4, a spring 5 and a lead housing tube 6 combined with a closure, a lead protective device (C) being slidably mounted in the forward end tube 2 and slidable in and out of an insertion hole 7.

Figure 4:
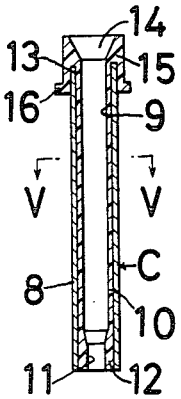
FIG. 4 is a sectional view, on an enlarged scale, of the lead protective device according to the invention.

As shown in FIG. 4, the lead protective device (C) has a lead insertion pipe 8 made of metal, such as stainless steel or the like, having an outside diameter of 0.7–1.3 mm the same as in the case of an ordinary fine lead mechanical pencil so that the occurrence of a dead angle will not impede the writing. When the lead has an outside diameter of 0.5 mm, the lead insertion tube 8 has an outside diameter of 1.3 mm and a substantially uniform inside diameter of 1 mm. In practice the ordinary 0.5 mm lead has an outside diameter slightly larger than 0.5 mm, for example, 0.55–0.58 mm.

A thin film 10 made of an elastic material, such as rubber, synthetic resin or the like, is integrally superposed directly or by means of an adhesive over the whole periphery of the inner surface 9 of the lead insertion tube 8. The thin film 10 has a relatively greater thickness in the forward end portion 11 than in the remainder of the film so that the inside diameter is smaller than the outside diameter of the lead so that it acts as a lead sustaining portion 12. The thickness of the thin film from the rearward end 13 to the forward end 13 other than the lead sustaining portion 12 is less than the forward end so that the inside diameter is relatively larger than the outside diameter of the lead thereby enabling the lead to pass therethrough with ease.

At the rearward end 13 of the lead insertion tube 8 there is a lead guide 15 having a funnel-shaped lead guide hole 14 and an integral check flange 16 provided on the outside thereof.

The flange 16 may be omitted if the lead guide 15 has a large outside diameter so that it can carry out a slip-checking function. Alternatively, a flange may be provided directly on the lead insertion tube 8.

In case of the use of a 0.5 mm lead, for example, the thin film is preferably given a thickness of about 0.24 mm for the lead sustaining portion 12 and about 0.20 mm for the non-sustaining part from the rearward end to the forward end other than the lead sustaining portion 12.

Figure 6:
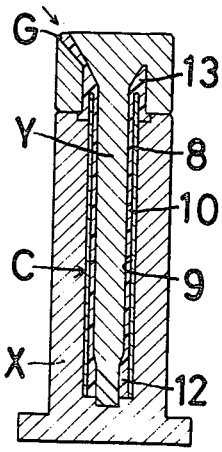
FIG. 6 is a diagram explaining how to produce the lead protective device according to the invention.

The method of producing the lead sustaining device according to the invention will not be described in detail in reference to FIG. 6

The inner surface 9 of the lead insertion tube 8 is coated with an adhesive by immersing the pipe 8 in an adhesive solution. Alternatively, as shown in FIG. 6, the lead insertion pipe 8 with no adhesive applied thereto is inserted into a metal mold (X), another metal mold (Y) is positioned therewithin, and melted synthetic rubber, such as nitril butadiene rubber, styrene butadiene rubber, fluorine rubber, chloroprene rubber, silicone rubber, or synthetic resin, for example, polyethylene, vinyl acetate, polypropylene or the like, is poured in under pressure and then cooled. Thus, the inner surface 9 of the lead insertion tube 8 is integrally coated with an elastic thin film 10 to form the lead protective device (C).

Figure 5:
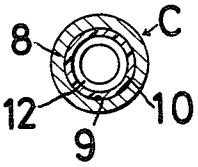
FIG. 5 is a sectional view taken along the line V—V of FIG. 4.
Figure 7:
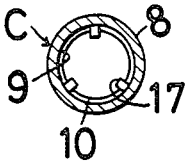
FIG. 7 is a cross sectional view showing another embodiment of the invention.

It is not always necessary that the elastic thin film be formed over the entire inner periphery of the lead sustaining portion as shown in FIG. 5. Alternatively, a plurality of projecting ridges 17 may be formed as shown in FIG. 7.

Furthermore, instead of the aforementioned slide system, the lead protective device (C) may be fixedly secured to the forward end of the pencil body (A).

According to the invention, as described hereinbefore, a thin film made of an elastic material, such as rubber, synthetic resin or the like, is provided over the whole length of the inner surface of the lead insertion tube with a thickness such that the lead can pass therethrough with ease, an elastic thin film having a relatively greater thickness being integrally formed in the forward end part of the lead insertion tube so that its inside diameter is relatively smaller than the outside diameter of the lead, thereby minimizing the length of the waste lead. The invention has a further advantage in that, since the thin elastic film can be formed in the lead insertion tube easily, not only the production efficiency but also the precision of the lead sustaining device is greatly improved. Moreover, the lead sustaining member is completely free from the risk of slipping out of the pencil in the course of writing as was frequently experienced with the conventional mechanical pencil.

In the case of the lead protective device for use in the mechanical pencil of the slide system, it can be produced at low cost since the check flange can be integrally formed thereon. The invention has further advantages, for example, the distance between the lead sustaining and feeding mechanism and the lead protective device can be reduced thereby minimizing the risk of breakage of the lead.

What is claimed is:

1. A mechanical pencil having a lead protective device, said pencil comprising: a pencil body; a lead insertion tube on the forward end of said pencil body and having a substantially uniform inner diameter; a thin film of an elastic material, such as rubber, synthetic resin or the like, on the inner surface of said lead insertion tube, the portion of the thin elastic film on the forward end of the tube having a greater thickness than the thickness of the film on the remainder of said tube for frictionally engaging a lead for preventing it from falling out of said insertion tube; and a lead guide integral with said film at the rear end of said tube and projecting out of said tube and having a rearwardly diverging funnel shaped hole opening into the interior of the remainder of said film, the material of said lead guide extending forwardly over the outer surface of said tube and having a check flange on the forward end thereof around the outside of said tube functioning as a check for preventing said tube from falling out of the pencil body.

* * * * *